United States Patent [19]

Kimura et al.

[11] 4,405,226

[45] Sep. 20, 1983

[54] DEVELOPING MATERIAL SUPPLYING CONTROL DEVICE FOR ELECTROSTATIC COPYING APPARATUS

[75] Inventors: Hiroshi Kimura, Neyagawa; Masahiko Hisajima, Osaka; Yutaka Shigemura, Takarazuka; Isao Yada, Neyagawa; Yoichiro Irie, Suita; Kiyoshi Morimoto, Osaka, all of Japan

[73] Assignee: Mita Industrial Company Limited, Osaka, Japan

[21] Appl. No.: 283,942

[22] Filed: Jul. 16, 1981

[30] Foreign Application Priority Data

Jul. 23, 1980 [JP] Japan ..... 55-101770

[51] Int. Cl.[3] ..... G03G 15/08

[52] U.S. Cl. ..... 355/14 D; 118/689; 222/DIG. 1; 355/3 DD

[58] Field of Search ..... 355/14 D, 3 DD; 118/668, 688, 694, 689; 222/DIG. 1

[56] References Cited

U.S. PATENT DOCUMENTS

| | | | |
|---|---|---|---|
| 3,572,551 | 3/1971 | Gillespie et al. | 222/DIG. 1 |
| 3,698,926 | 10/1972 | Furuichi | 118/689 X |
| 3,970,036 | 7/1976 | Baer et al. | 118/7 |
| 3,999,687 | 12/1976 | Baer et al. | 222/DIG. 1 |
| 4,088,092 | 5/1978 | Noguchi | 118/689 |
| 4,131,081 | 12/1978 | Terashima | 118/689 |
| 4,147,127 | 4/1979 | Terashima | 118/646 |
| 4,195,260 | 3/1980 | Sakamoto et al. | 222/DIG. 1 |
| 4,208,985 | 6/1980 | Anzai et al. | 118/689 |
| 4,210,864 | 7/1980 | Miyakawa et al. | 118/689 X |
| 4,226,525 | 10/1980 | Sakamoto et al. | 355/14 D |
| 4,240,375 | 12/1980 | Terashima | 118/689 |
| 4,257,348 | 3/1981 | Prohaska | 118/689 |

*Primary Examiner*—R. L. Moses

*Attorney, Agent, or Firm*—Wenderoth, Lind & Ponack

[57] ABSTRACT

The present invention relates to a developing material supplying control device for an electrostatic copying apparatus which includes an oscillator circuit composed of an oscillation coil provided along a toner supplying passage, a timer, a counter for counting the output signal from the oscillation circuit at every interval predetermined by the timer to supply a discriminating output signal when the counted value is equal to a predetermined value for each of the intervals. A toner supply acts in response to the discriminating output signal from the counter for supplying toner to the toner supplying passage. Since this invention employs the oscillation coil and does not employ a mechanical switch having a movable contact for detecting toner in the toner supplying passage, the toner supplying operation is achieved precisely.

2 Claims, 5 Drawing Figures

DEVELOPING MATERIAL SUPPLYING CONTROL DEVICE FOR ELECTROSTATIC COPYING APPARATUS

BACKGROUND OF THE INVENTION

1. Field of the Invention

The present invention relates to a developing material supplying control device for an electrostatic copying apparatus.

2. Description of the Prior Art

In a conventional developing material supplying control device, a movable contact member which is supported by a shaft to the copying apparatus housing by the weight of the developing material contacts with a fixed contact member when the movable contact member swings around the shaft. When the amount of developing material is reduced, the movable contact member returns to the home position because it is not effected by the weight of the developing material, and this interrupts the electrical contact between the movable contact member and the fixed contact member. According to this prior art arrangement, the movable contact member and the fixed contact member are apt to be polluted by the developing material. Therefore, there may occur a detection error that the developing material is thoroughly consumed, regardless of the existence of a large amount of developing material, because of an inaccurate interruption of electrical contact between the movable contact member and fixed contact member.

It is an object this invention to provide a developing material supplying control device operating correctly without error.

SUMMARY OF THE INVENTION

To accomplish the foregoing objective, there is provided a developing material supplying control device which comprises an oscillation circuit composed of an oscillation coil provided along or in a toner supplying passage, a timer, a counter for counting the output signal from the oscillation circuit at every interval predetermined by the timer to supply a discriminating output signal when the counted value is equal to a predetermined value for each of the intervals, and toner supplying means operable in response to the discriminating output signal from the counter for supplying the toner to the toner supplying passage.

In a preferred embodiment of this invention, the toner supplying means comprises a latch circuit in response to the output signal from the timer for storing the discriminating output signal from the counter for the same number of the interval as that of the discriminating output signal, toner storing means having a toner supplying roller to supply an amount of toner corresponding to a rotational angle of the toner supplying roller, and a motor operable in response to the stored signal from the latch circuit for driving the toner supplying roller.

Since this invention employs the oscillation coil and does not employ a mechanical switch having a movable contact for detecting the toner in the toner supplying passage, toner the supplying operation is achieved precisely.

BRIEF DESCRIPTION OF THE DRAWINGS

A detailed description of the invention will be made with reference to the accompanying drawings wherein like reference numerals designate corresponding like parts in the various figures.

DETAILED DESCRIPTION OF THE PREFERRED EMBODIMENT

The following detailed description is of the best presently contemplated mode of carrying out the invention. This description is not to be taken in a limited sense, but is made merely for the purpose of illustrating the general principals of the invention since the scope of the invention is best defined by the appended claims.

The present invention relates to a developing material supplying control device for an electrostatic copying apparatus which indicates whether or not the developing material should be supplied, and which allows a supplying device to supply the developing material when the amount of powdered developing material is reduced, and more particularly, to a supplying control device for a dual component developing material including a magnetic carrier and a toner and for a single component developing material, the toner of which itself has magnetic properties.

Figure 1:
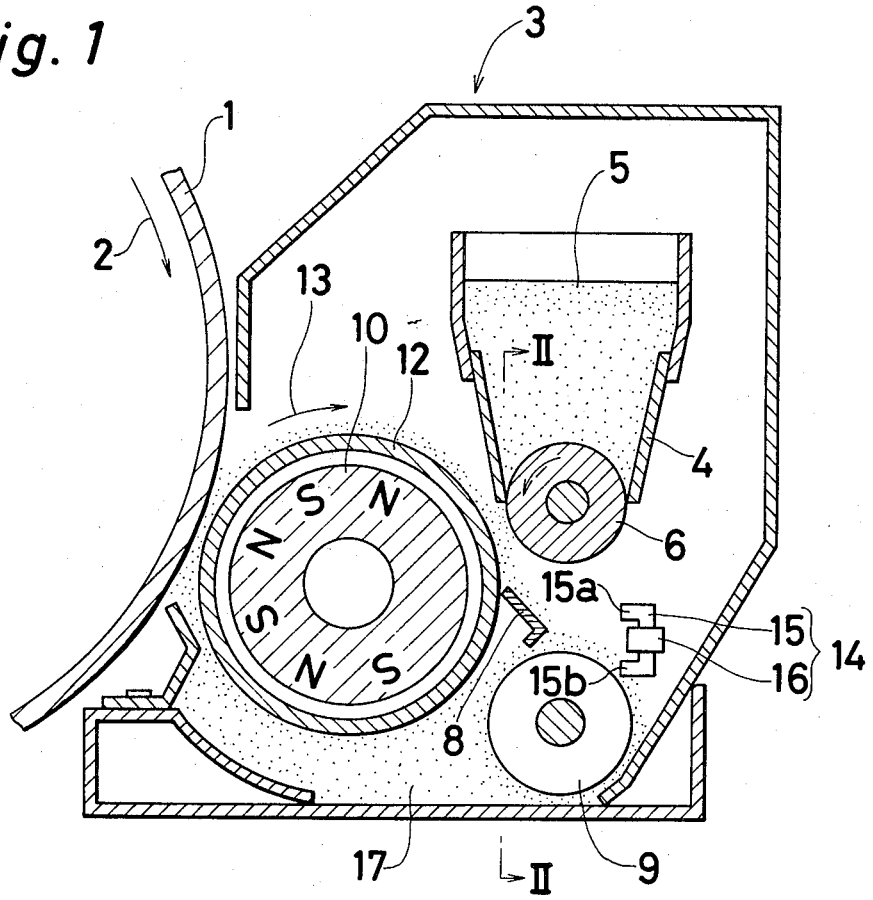
FIG. 1 is a vertical section of a developing device embodying the concept of the present invention.
Figure 2:
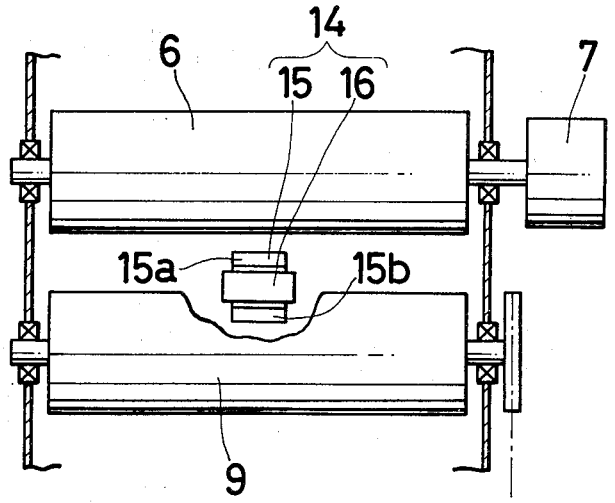
FIG. 2 is a simplified sectional view of FIG. 1 taken along line II—II therein.

FIG. 1 is a vertical section of a developing device according to a preferred embodiment of the invention. FIG. 2 is a simplified sectional view taken along the line II—II of FIG. 1. On the surface of a photosensitive drum 1 of the electrostatic copying apparatus, an electrostatic image corresponding to a document is formed by exposure. The photosensitive drum 1 rotates in the direction of an arrow 2. The electrostatic image on the photosensitive drum 1 is developed by a dual component developing material. Subsequently, the developed image on the photosensitive drum 1 is transferred onto a sheet of copy paper. The toner image on the copy paper is fixed by a fixing device, and a single copying process thus is completed.

In the developing device 3, toner 5 is stored in a hopper 4. A toner supplying roller 6 which is provided under the hopper 4 is rotated by a motor 7 and supplies an amount of toner 5 downwardly according to the amount of rotation of the toner supplying roller 6. A guide member 8 leads the toner 5 from the hopper 4 to a stirring roller 9. Thus, the toner is mixed with a magnetic carrier in a sump 17.

A permanent magnet bar 10 which circumferentially has a plurality of alternate magnet poles in the rotative direction is fixed to the copying apparatus housing. The magnet bar 10 extends through a developing sleeve 12 made of non-magnetic material. The dual component developing material including magnetic carrier and toner is magnetically adhered onto the developing sleeve 12. With the rotation of the developing sleeve 12 in the direction of an arrow 13, the developing material moves in the rotational direction 13. The developing step is accomplished because of electrical adhesion on the photosensitive drum 1 by the toner from a magnetic brush of the developing material formed on the surface of the developing sleeve 12. Both the toner that was not consumed during a developing and the carrier are removed from sleeve 12 and passed by guide member 8 to the stirring roller 9 to be mixed again for further development.

A magnetic device 14 is composed of a U detecting shaped magnetic core 15 and an oscillation coil 16 that is wound around the web or base portion of the magnetic core 15. The magnetic detecting device 14 is provided in a position opposite to the developing sleeve 12 with respect to the stirring roller 9 (to the right in FIG. 1). Free ends 15*a* and 15*b* of the magnetic core 15 face toward the stirring roller 9 and developing sleeve 12. As a large amount of developing material flows between the free ends 15*a* and 15*b*, the magnetic resistance of the magnetic core 15 decreases, which decreases the inductance of the oscillation coil 16. Because the free ends 15*a* and 15*b* of the magnetic core 15 are mounted in the path through which the developing material passes and flows along the stirring roller 9, the inductance of the oscillation coil 16 in altered depending on the amount of such developing material. When a large amount of toner is consumed by the development of the electrostatic image on the photosensitive drum 1, the ratio of the magnetic carrier to the toner in the sump 17 increases, thus the developing density decreases. In the above-stated condition, a relatively small amount of the developing material flows between the free ends 15*a* and 15*b* of the magnetic core 15, and therefore, the inductance of the oscillation coil 16 decreases.

Figure 3:
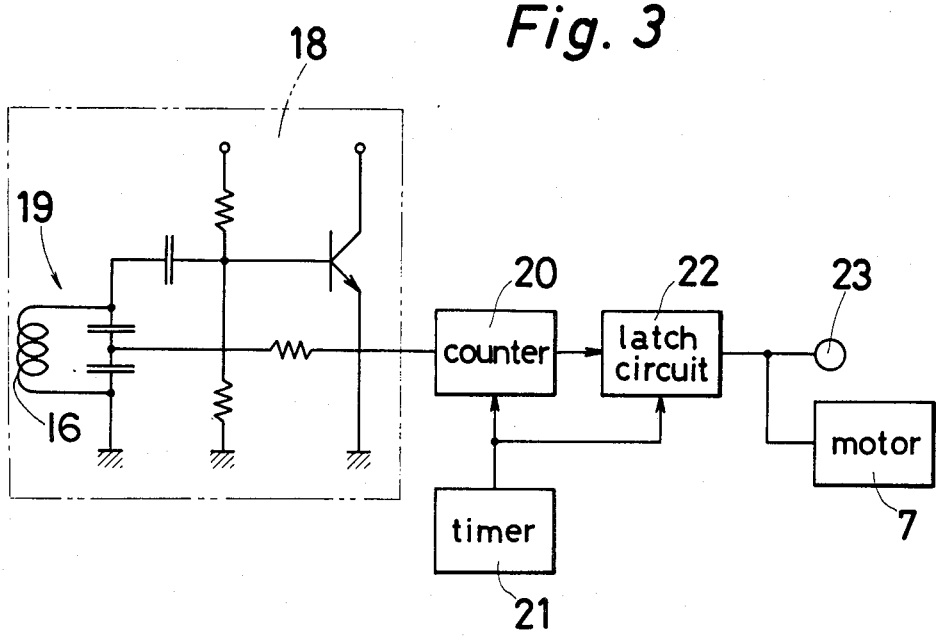
FIG. 3 is an electric circuit diagram of an embodiment of an oscillation coil of the invention.
Figure 4:
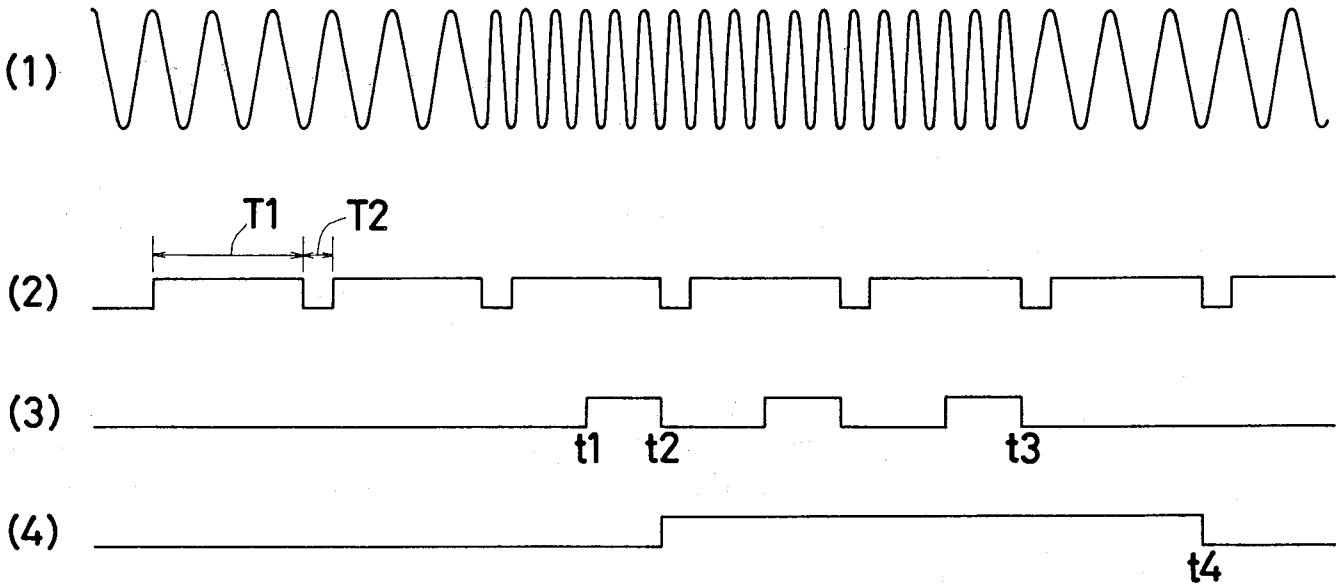
FIG. 4 is a wave form diagram that explains the operation of the electric circuit diagram of FIG. 3.

FIG. 3 is an electric circuit diagram of the oscillation coil 16. The oscillation coil 16 includes a tank circuit 19 in a Colpitts oscillation circuit 18. The output frequency from the oscillation circuit 18 is chosen within the order of 100 KHz, for example. The output wave form from the oscillation circuit 18 is a sine wave as represented in FIG. 4 (1). The output from the oscillation circuit 18 is provided to a counter 20 to be counted by a timer 21 at predetermined intervals. The output wave from the timer 21 is maintained to be high level during a counting period T1 and to be low level during a reset period T2 which is shorter than the counting period T1. The counting period T1 may be chosen as 0.1 seconds, for example. The output from the counter 20 is provided to a latch circuit 22. An edge triggered flip-flop may be employed for the latch circuit 22, and it stores the output signal from the counter 20 in response to the trailing edge of the output signal from the timer 21. In response to the output signal from the latch circuit 22, a lamp 23 turns on and it shows that the toner amount in the sump 17 is reduced, and the motor 7 is driven to supply additional toner to the sump 17 from the hopper 4. When a sufficient amount of toner is contained in the sump 17, the inductance of the oscillation coil 16 increases as mentioned above, and the counted value counted at the counter 20, at every predetermined period T1, is lower than the predetermined value. Therefore the output from the counter 20 is maintained low level.

When a large amout of toner in the sump 17 is consumed, the amount of developing material that contacts with the free ends 15*a* and 15*b* of the magnetic core 15 is reduced. Accordingly, the inductance of the oscillation coil 16 decreases. When the oscillation frequency from the oscillation circuit 18 increases and the counting value counted by the counter 20 at every counting period T1 increases to reach the predetermined value at t1 represented in FIG. 4 (3) for example, the output signal from the counter 20 turns from low level to high level, and returns to low level at t2, the end of the counting period T1. The latch circuit 22 provides a high-level output which was turned from low level in response to the trailing edge of the output signal from the counter 20 at t2, represented in FIG. 4 (4). In response, the lamp 23 turns on, and the motor 7 is driven. The motor 7 being driven, the toner supplying roller 6 is rotated, and the toner 5 in the hopper 4 is supplied to the sump 17. When the ratio of the toner in the sump is desirable, the inductance of the oscillation coil 16 increases again. And the frequency of the oscillation circuit 18 becomes low level. Accordingly, the output from the counter 20 remains low level again, during the counting period T1 after t3 in FIG. 4 (3). Accordingly, the output from the latch circuit 22 is low level after t4 in FIG. 4 (4). Thus, the lamp 23 turns off, and the driving of the motor 7 is stopped.

The amount of consumed toner in the sump 17 may be detected precisely by setting the frequency of the oscillation circuit 18 relatively high, and choosing a long counting period T1 by the timer 21.

According to another aspect of the invention, either of the lamp 23 or motor 7 may be provided, and those embodiments are included in the scope of the invention.

Figure 5:
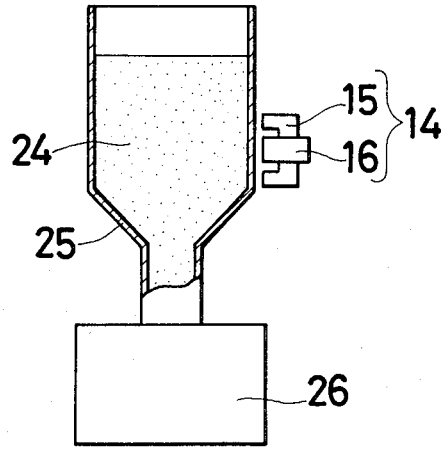
FIG. 5 is a simplified sectional view of an another embodiment of the invention.

FIG. 5 is a simplified sectional view of another embodiment of the invention. According to this embodiment, a single component developing material 24, the toner of which itself has magnetic properties, is contained in a hopper 25. The hopper 25 is made of nonmagnetic material. A magnetic detecting device 14 having the same construction as in the above-mentioned embodiment is provided close to the hopper 25. The developing material in the hopper 25 is gradually supplied to a developing material supplying device 26 to be used for development. The oscillation coil 16 which is wound around the magnetic core 15 of the magnetic detecting device 14 includes a portion of the tank circuit 19 in the oscillation circuit 18 represented in FIG. 3. The construction is otherwise the same as in the previous embodiment, while the motor 7 and stirring roller 9 are omitted from FIG. 5.

What is claimed is:

1. A developing material supply control device for use in an electrostatic copying apparatus, said device comprising:

an oscillation circuit, including an oscillation coil and adapted to be positioned along a toner supply passage, for generating an output signal representative of the relative amount of toner present at said passage;

a timer for providing predetermined time intervals;

a counter for counting said output signal from said oscillation circuit at every interval predetermined by said timer to supply a discriminating output signal when the counted value is equal to a predetermined value for each of the intervals; and toner supply means operable in response to said discriminating output signal from said counter for supplying toner to said toner supply passage.

2. A device as claimed in claim 1, wherein said toner supply means comprises a latch circuit operable in response to an output signal from said timer for storing said discriminating output signal from said counter for the same interval as that of said discriminating output signal, toner storing means for storing a supply of toner and including a toner supply roller for supplying a quantity of the stored toner according to the degree of rotation of said roller, and a motor operable in response to said stored signal from said latch circuit for rotating said roller.

* * * * *